United States Patent [19]

Wargin et al.

[11] 4,096,351

[45] Jun. 20, 1978

[54] INSULATED AND BRAID COVERED ELECTRICAL CONDUCTOR FOR USE IN GASSY OIL WELLS

[75] Inventors: Robert V. Wargin, Darien, Ill.; Clinton A. Boyd, Tulsa, Okla.

[73] Assignee: Borg-Warner Corporation, Chicago, Ill.

[21] Appl. No.: 717,437

[22] Filed: Aug. 24, 1976

[51] Int. Cl.[2] ..... H01B 7/18; H01B 3/28

[52] U.S. Cl. ..... 174/102 R; 174/110 AR; 174/120 AR

[58] Field of Search ..... 174/102 R, 102 SP, 102 D, 174/110 AR, 110 PM, 120 AR, 120 SR, 121 AR, 121 SR, 120 R, 108, 109

[56] References Cited

U.S. PATENT DOCUMENTS

| | | | |
|---|---|---|---|
| 2,727,087 | 12/1955 | Hull | 174/109 |
| 3,621,118 | 11/1971 | Bunish et al. | 174/121 SR X |
| 3,634,607 | 1/1972 | Coleman | 174/108 X |
| 3,710,007 | 1/1973 | Hoeg et al. | 174/110 AR X |
| 3,710,009 | 1/1973 | Hoeg et al. | 174/110 AR X |
| 3,742,363 | 6/1973 | Carle | 174/102 D X |
| 3,832,481 | 8/1974 | Boyd et al. | 174/110 AR X |
| 3,889,049 | 6/1975 | Legg et al. | 174/108 X |

OTHER PUBLICATIONS

Luh, D.R, *Ethlene Propylene Terpolymers in Wire and Cable Construction,* Wire & Wire Products, Apr., 1970, pp. 79–81.

*Primary Examiner*—Arthur T. Grimley
*Attorney, Agent, or Firm*—Richard J. Schlott

[57] ABSTRACT

Electrical conductors having an insulation layer comprising a thermosetting elastomeric composition capable of imbibing low molecular weight hydrocarbon well fluids when under pressure and rapidly desorbing the fluids when pressure is removed, and surrounded by a confining braid layer are able to withstand use in gassy oil wells without consequent depressurization-caused rupture failures. Armored electrical cables formed from these insulated conductors without an elastomeric jacketing are suitable for use in powering electric motors in oil wells that have particularly high proportions of gassy hydrocarbons under pressure without undergoing rupture failure.

4 Claims, 2 Drawing Figures fig. 1.
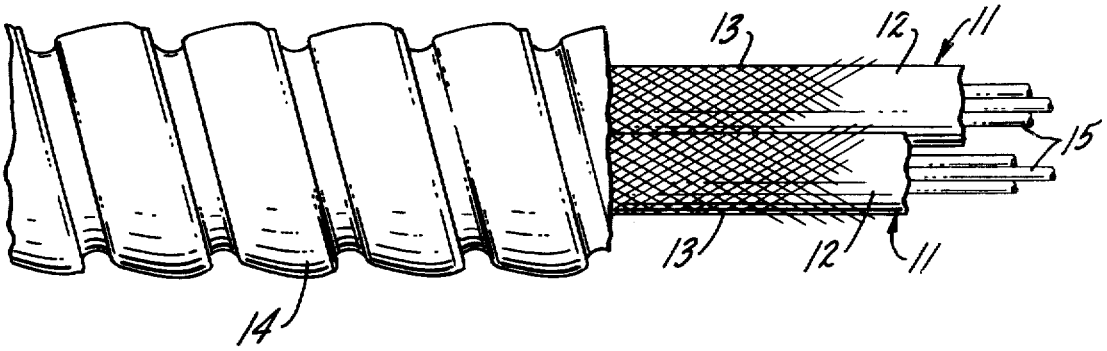
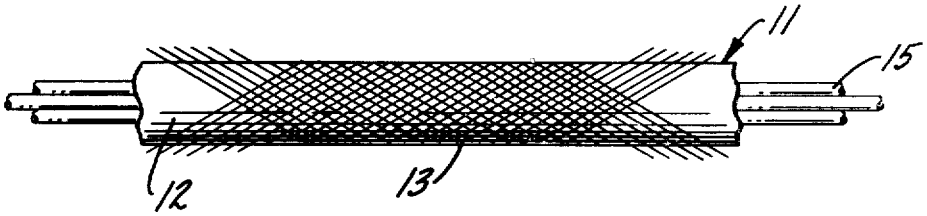
fig. 2.

INSULATED AND BRAID COVERED ELECTRICAL CONDUCTOR FOR USE IN GASSY OIL WELLS

Related U.S. application Ser. No. 717,436, filed Aug. 24, 1976, contains related subject matter.

BACKGROUND OF THE INVENTION

This invention relates to electrical cables. More particularly it relates to an insulated electrical conductor for use in high temperature, high pressure gassy oil wells adapted to prevent depressurization-caused rupture failures from occurring in service and during removal from the well bore, and to cables constructed thereof.

Prior art cable structures employed for oil well service include those having conductors of stranded copper, separately insulated with a material of high dielectric strength. To protect the insulated conductors from attack by well fluids, they are sheathed in an extruded elastomeric jacket adapted to resist penetration by the well fluids. Typical of these prior art cables is the structure disclosed in U.S. Pat. No. 3,485,939, having three conductors of stranded copper separately insulated and helically wound and sheathed in an extruded jacket of nitrile rubber or a similar elastomer. The rubber jacket is surrounded by an outer armor formed of a continuous wrapped band of a metallic material. The outer armor does not provide an hermetic seal, and exclusion of well fluids from the internal structure is intended to be accomplished by means of the water-resistant and hydrocarbon-impervious jacketing material. Invasion of these cable structures by low molecular weight well fluids occurs particularly when the cables are employed in highly gassy wells, either through gas permeation or by way of pinholes and other defects in the jacket. Although the jacketing and insulation layers of these prior art cables have been designed to resist chemical attack and deterioration when permeated by well fluids, the presence of low molecular weight hydrocarbons and gases under high pressure within the interstices of the cable structure frequently causes mechanical destruction such as blow outs and rupture failures. These ruptures are particularly likely to occur when the external pressure on the cable is decreased, as for example when the cable is removed from the well bore, inasmuch as these cables are not designed to withstand an unbalanced high internal pressure condition. The high internal pressures induce ballooning of the insulation and the jacketing material which then burst and rupture the metal armor, rendering the cable useless.

An improved prior art cable design, disclosed in U.S. Pat. No. 3,710,009, includes an extruded outer armor formed of a water-impervious, high temperature, heat-resistant polyolefin. The extruded armor provides a further mechanical barrier to invasion by well fluids. In practice it has been found that the interstices of these cable structures can also be penetrated by the low molecular weight hydrocarbons in highly gassy wells either by way of gas permeation or through defects and these cable structures similarly suffer from blow-out and rupture of the insulation, jacketing and armor, particularly during rapid depressurizing.

In a third prior art cable construction, disclosed in U.S. Pat. No. 3,835,929, the jacketed well cable is encased in a continuous metallic tube, sealed at the lower end and extending to the surface. Such constructions are difficult to employ in the field, and require cables having tensile strength sufficient to withstand installation in an unsupported manner through the entire length of the tubing. Additionally, intrusion of low molecular weight well fluids such as methane under high pressure through a defective seal means at the lower end would result in a fluid-filled conduit which turn would make subsequent removal of the cable both difficult and hazardous.

Other methods for protecting well cables from invasion by highly pressurized low molecular weight well fluids have also generally relied on a combination of materials to enhance the cable's mechanical resistance to penetration. It has not heretofore been possible to completely prevent gas permeation of these cables when under very high pressure, and a cable structure for use in gassy wells capable of withstanding permeation by low molecular weight well fluids without consequent ruptures and blow out failures would clearly be a welcome advance in the art.

SUMMARY OF THE INVENTION

The present invention relates to an improved electrical cable structure for use with submersible motors, capable of withstanding permeation by low molecular weight well fluids under pressure without subsequent ruptures and blow out failures being caused by rapid depressurization. More particularly, the present invention relates to an electrical conductor separately insulated with a layer of a polymeric material adapted to resist attack by well fluids and surrounded by a confining braid layer, said insulated conductor being particularly useful in providing electrical cables for service in high temperature high pressure gassy oil wells when disposed in an outer armor, and to electrical cables constructed thereof.

The conductor insulation disclosed for use in high temperature, high pressure gassy oil wells is a thermosetting elastomeric polymer which is an excellent electrical insulator at elevated temperatures and virtually impervious to attack and deterioration by oil and other well fluids. An essential property of the conductor insulation is a limited degree of porosity in that it is capable of imbibing very low molecular weight hydrocarbons found in gassy oil wells, e.g. methane, ethane and the like, when under high pressure and then rapidly desorbing the imbibed gassy hydrocarbons when external pressure is removed. One such material useful for these purposes is a modified EPDM (ethylene-propylene - diene monomer terpolymer) blend such as is disclosed in U.S. Pat. No. 3,926,900.

The insulated conductors are each surrounded and confined by a layer of braid. Materials commonly employed in the cable art for this purpose include a variety of nylon filament braids, and a material particularly useful for this purpose is a nylon 66, braided and lacquered with a nylon lacquer.

Insulated and braid-wrapped conductors of this invention are suitable for service when immersed in and surrounded by the well fluids under high temperatures and pressures, and are not susceptable to depressurization failure. The conductor insulation is particularly insensitive to well fluids, and protects and insulates the conductor. The braid layer tightly surrounds the insulation. Where minor amounts of low molecular weight well fluid permeate the somewhat porous insulation layer and perhaps invade the conductor area, the braid layer restrains the insulation layer against swell and rupture from high internal pressure, and the low molecular weight fluids are desorbed without rupture or damage to the insulation.

When formed into electrical cables, the insulated conductors of this invention are not enclosed within an elastomeric jacketing, but rather are disposed within an outer armor adapted to be freely penetrated by the well fluids. The outer armor provides mechanical protection against abrasion and damage in use. The armor does not provide an hermetic seal, and may even be perforated. Conventional armors formed from a wrapped band of metallic material are suitable for the purposes of this invention. Ingress and egress of well fluids to and from the internal portion of the cable structure occurs by way of the armor, and the absence of an impermeable jacketing permits the fluids to freely escape during a rapid depressurizing.

In prior art cable constructions such as those disclosed in U.S. Pat. No. 3,485,989, the insulated conductors are surrounded first by an elastomeric jacketing, then by an outer armor. The elastomeric jacketing is provided to afford a mechanical barrier to penetration by well fluids, thereby preventing attack and consequent weakening of the primary insulation layer. The outer armor is provided to protect the cable from abrasion and consequent weakening of the jacketing. When used in particularly gassy wells, gas permeation of these prior art cable structures occurs by way of absorption or defects. The low molecular weight fluids then present within the structure under high pressure are trapped by the non-porous impermeable jacketing during a subsequent depressurization. Escape of the fluid cannot occur rapidly, and the jacketing consequently balloons, causing rupture of the jacket and the armor. In these prior art cables, the jacketing could not be ommitted since the conductor insulation would then be subject to penetration by low molecular weight well fluids, ballooning and rupture failure upon depressurizing and consequent dielectric failure and burn-outs.

In cable constructions employing the insulated conductors of the present invention the need for jacketing is obviated by the use of a relatively thin insulation layer capable of imbibing and desorbing low molecular weight well fluids surrounded and confined by a braid layer. Where minor amounts of low molecular weight well fluids succeed in permeating the thin insulating layer and penetrating into the area between the conductor strands, the confining braid layer has sufficient mechanical strength to restrain swell, thus preventing ballooning and blow-out failure and requiring the low molecular weight well fluids to escape from the insulation layer by desorption. Without jacketing, the well fluids can freely escape through the outer armor during depressurization. A high and unbalanced internal pressure condition is thereby avoided and costly blow-outs and rupture failures of the cable will not occur.

Further advantages of the present structure will become apparent with reference to the following description and accompanying drawings.

DESCRIPTION OF THE DRAWINGS

FIG. 1 is a view of a section of electrical conducting cable constructed from a plurality of the electrical conductors of FIG. 2.

FIG. 2 is a view of a section of electrical conductor for submersible motors illustrating various features of the invention.

DESCRIPTION OF THE ILLUSTRATED EMBODIMENTS

Referring now to the drawings, there is shown a multicomponent insulated electrical conductor designed for use in high pressure gassy oil wells which is illustrative of the principles of the present invention.

FIG. 2 shows a conductor section which includes conductors 11, insulation 12 and braid layer 13.

Each conductor 11 is formed of stranded wire 15 helically wound and blocked to prevent separation of strands. These separate strands may be tinned to minimize chemical interaction between the conductor and the insulating material.

In the illustrated embodiment each conductor includes seven strands. The number of conductors, the diameter of the conductor and the number of wires is, of course, dependent upon the electrical load carrying capabilities required for a particular cable application. It should additionally be noted that any suitable conducting material may be used, such as for example, copper, aluminum, etc.

The wound set of wire strands forms a single conductor and is insulated by an insulation layer 12. The conductor insulation 12 is formed of a high temperature, oil-and brine resistant polymer insulation material.

Insulation materials useful for the purposes of this invention are thermosetting elastomeric compositions which will not be subject to chemical attack by well fluids, and which will resist being swelled or softened by hydrocarbons. The insulation materials must not provide a complete barrier to gas permeation or penetration at the molecular level by very low molecular weight hydrocarbon fluids including methane under high pressure, and they may even be highly permeable to hydrocarbon gases, however the physical and electrical properties of the insulation layer must remain essentially unaffected thereby.

One insulation material found to be satisfactory for this purpose is a modified EPDM blend as disclosed in U.S. Pat No. 3,926,900. A blend represented by the following formulation may be employed as the insulation material in the practice of this invention:

| Material | Parts by Weight | Source |
|---|---|---|
| EPDM with Napthenic Oil, 2:1 | 105 | B. F. Goodrich Co. |
| Liquid Polybutadiene | 30 | Lithcoa |
| Zinc Oxide | 5 | |
| Stearic Acid | 1 | |
| Dihydroquinoline | 1 | |
| Titanium Dioxide | 10 | |
| Clay | 100 | |
| Trimethylolpropane Trimethacrylate | 2 | Ware Chemical Co. |
| Peroxide | 11 | Hercules Chemical Co. Dicup 40KE |

This insulation material will be extruded unto the conductor and cured in place to provide an insulation layer resistant to attack by water and well fluids. A characteristic property of this insulation material is that it will imbibe gassy low molecular weight hydrocarbons under pressure and rapidly desorb the imbibed hydrocarbons when the external pressure is removed. Depending upon the conductor material employed, further stabilization to heat and metals may be required and the use of stabilizers for this purpose is widely known in the insulation art. The thickness of the insulation layer may be varied according to the electrical insulation requirements of the cable and the size of the particular conductors employed. Excessive thickness is to be avoided, however, inasmuch as the rate of desorption of minor amounts of low molecular weight well fluids from within the insulation layer will be dependent upon the thickness of the insulating material, and the preferred thickness will be in the range of 0.020 to 0.150 in., more preferably between 0.070 and 0.100 in. To provide added electrical insulation for use in extreme temperature conditions, a thin layer of a high temperature fluorocarbon polymer may be included either as a first or second layer in the manner set forth in U.S. Pat. No. 3,832,481, or more preferably in the form of overlapping wrap of fluorocarbon polymer tape.

The insulated conductor is then tightly covered with a braid layer 13. While a number of synthetic and natural fibers have been employed in the art as braid for insulation purposes, fiber materials suitable for the purposes of this invention will be resistant to attack by well fluids at elevated temperatures and including fibers of nylon, fluoropolymers, high temperature polyamides and the like. A preferred material is a conventional nylon 6—6 continuous filament yarn braid. Methods for applying braid to an insulated conductor are widely known. It is necessary that the braid be tightly formed to the insulation layer and have sufficient tensile properties to contain and restrain the insulation layer against ballooning and consequent rupture where high internal pressures obtain during use. Added strength may be afforded by a post-lacquering of the braid layer.

In FIG. 1 is shown a cable section including 3 conductors, insulated and braid-wrapped as described hereinabove, and an outer armor 14.

The insulated, braid-wrapped conductors are cabled and disposed within the outer armor 14, formed of a continuous wrapped band of metallic material. The metallic band may be formed of a galvanized or zinc-plated low carbon steel or bronze. The commercially available and common versions of galvanized or zinc-plated metal armor are generally satisfactory, however where highly corrosive well fluids may be encountered, the armor may have to be formed of a stainless steel or an exotic metal such as monel metal. The primary function of the armor is to provide mechanical protection against abrasion of the insulated conductors and not to act as a barrier to well fluids, which freely enter the cable by way of the openings between adjacent bands. The permeability may further be increased by perforating the metal band if desired. Conventional cable jacketing is not employed in these cable structures. During the armoring operation, the wound conductors may optionally be formed into a unit by a wrap of filler cloth, paper tape or other porous material if desired. This practice is frequently employed in the cable art to hold the insulated conductors securely in proper relationship during the armoring operation and to protect the insulation layer from damage, however, for the purposes of the instant invention the practice is optional.

EXAMPLE 1

A well cable illustrating features of the present invention has been constructed. It includes 3 seven-wire, stranded copper conductors, each of which is surrounded by an insulated layer having an average thickness of 0.100 inches formed of a modified EPDM blend as given hereinabove, and each in turn being tightly surrounded by a braid layer of nylon monofilament.

The paricular nylon braid is formed of 200/10 denier nylon 66, with 3 ends, dry woven 2 over and 2 under, to give a braid having 18.75 picks per inch. The braid is post-lacquered with three dips of an alcohol-water solution of nylon, each air-dried.

The separate conductors are wound and wrapped as a unit with filler cloth and provided with an outer armor formed of a continuous wrapped and interlocking band of galvanized low carbon steel.

A section of this cable was placed in a gassy oil well at 6700 ft. for three weeks. On removal from the well, the cable was dissected and the insulated conductors examined. No ruptures or other defects were found.

EXAMPLE 2

As a further test, a cable was constructed employing three conductors each having an insulation layer of the modified EPDM composition described herein but omitting the braid layer. A section of this cable was placed within the gassy oil well at 6700 ft. for 3 weeks. Upon removal, the cable was dissected and the insulated conductors examined. The insulation layer had been ruptured and split, demonstrating the need for constraining the porous insulation layer with braid during the depressurizing and desorption of the gaseous hydrocarbons.

EXAMPLE 3

A cable was constructed employing conductors each having a first insulation layer of the modified EPDM composition described herein, an extruded second insulation layer formed of conventional nitrile rubber, and surrounded by a nylon braid layer and post-laquered as in Example 1. A section of this cable was placed in the gassy oil well for 3 weeks. Upon removal, the insulation layers had ruptured and broken the confining braid. The failure was created by the presence of the impermeable, non-porous nitrile rubber layer which trapped the high pressure, low molecular weight hydrocarbon well fluids within the conductor. Upon rapid depressurizing the trapped fluids could not be desorbed through the impermeable nitrile insulation layer and localized stresses consequently ballooned the insulation and ruptured the braid layer.

EXAMPLE 4

For control purposes, a cable section constructed according to U.S. Pat. No. 3,485,989 and having conductor insulation of polypropylene, and jacketing of epichlorohydrin rubber was placed in the gassy well. After 3 weeks the cable was removed. The jacketing retained the gaseous well fluids and was ballooned to nearly twice the original diameter.

As can be appreciated, when in service within a gassy oil well, the well fluids under high pressure freely invade cable structures of this invention by way of the armor, but are prevented from contact with the conductors by the oil-and-water resistant permeable insulation layer. Minor amounts of the low molecular weight hydrocarbon fluids such as methane present in the well under high pressure may penetrate the insulation layer by way of chemical and/or physical absorption processes, but the effect on the insulation layer will be minimal. Upon rapid depressurizing, as for example, during removal of the cable from the well, the bulk of the well fluid is free to escape from the internal cable structure through the armor unhindered by any jacketing. Minor amounts of hydrocarbon fluid present in the porous insulation layer and possibly within the stranded conductors are prevented from rupturing or blowing-out the insulation layer by the tightly-confining braid layer and so are constrained to escape by a de-sorption process.

It will be understood that this blowing-out or rupture was not preventable by prior art cable constructions such as those found in U.S. Pat No. 3,485,939 inasmuch as the relatively thick, gas-impervious, non-porous jacketing materials such as nitrile rubber and the like retained the pressurized fluids that penetrated into and through the jacketing. These jacketed cables were ballooned from within by the high pressure fluids and both the jacketing and the armor were ruptured. It will be further understood that the prior art insulated conductors alone were equally unsuited for use in gassy wells inasmuch as the insulation materials employed, including nitrile rubber, polypropylene and the like, when penetrated by low molecular weight hydrocarbons under pressure, did not permit rapid desorption of these gassy hydrocarbons upon being depressurized. The low molecular weight hydrocarbons retained within the conductor thus ballooned and burst these prior art insulation layers.

The instant invention will thus be seen to be an insulated conductor suitable for use in the environments within gassy oil wells having a relatively thin insulation layer formed of a thermosetting polymeric material resistant to attack by well fluids but capable of imbibing and de-sorbing low molecular weight hydrocarbons surrounded by a braid layer adapted to confine the insulation layer and restrain against swell and blow-out from an unbalanced internal pressure condition, and an armored cable comprising a plurality of said conductors disposed within a permeable armor without jacketing.

Various features of the invention have been particularly shown and described in connection with the illustration embodiments of the invention. However, it must be understood that these particular arrangements are for illustrative purposes and that the invention is to be given its fullest interpretation within the scope of the appended claims.

We claim:

1. A multi-component electrical conductor comprising an electrical conductor, an oil-and brine-resistant insulating material surrounding said conductor formed of a cured composition comprising EPDM (ethylene-propylenediene monomer terpolymer), hydrocarbon oil and polybutadiene; and a braid layer formed from a fiber selected from the group consisting of nylon fiber, polyethylene terephthalate fiber, glass fiber, polyamide fiber, and fluropolymer fiber surrounding and confining said insulating material.

2. The conductor of claim 1 wherein the insulating material further comprises a second layer consisting of an overlapping wrap of fluorocarbon polymer tape.

3. An electrical cable having a plurality of conductors, each of said conductors being surrounded by a layer of oil-and brine-resistant thermosetting insulating material, said insulating material being formed of a cured composition comprising EPDM (ethylene-propylene-diene monomer terpolymer), hydrocarbon oil and polybutadiene, said layer of insulating material being surrounded and confined by a braid layer formed from a fiber selected from nylon fiber, polyamide fiber, glass fiber, polyethylene terephthalate fiber and fluorocarbon polymer fiber, and a metallic outer armor surrounding said conductors said armor adapted to permit free flow of well fluids into the cable structure.

4. The cable of claim 3 wherein the insulating material further comprises a second layer consisting of an overlapping wrap of fluorocarbon polymer tape.

* * * * *